US011230094B2

(12) United States Patent
Martellono

(10) Patent No.: US 11,230,094 B2
(45) Date of Patent: Jan. 25, 2022

(54) THERMOSETTING UNIT, IN PARTICULAR FOR A TEXTILE PRINTER

(71) Applicant: ATPCOLOR S.r.l., Senago (IT)

(72) Inventor: Roberto Maria Martellono, Cerano (IT)

(73) Assignee: ATPCOLOR S.r.l.

( * ) Notice: Subject to any disclaimer, the term of this patent is extended or adjusted under 35 U.S.C. 154(b) by 0 days.

(21) Appl. No.: 16/924,255

(22) Filed: Jul. 9, 2020

(65) Prior Publication Data

US 2021/0008870 A1 Jan. 14, 2021

(30) Foreign Application Priority Data

Jul. 11, 2019 (IT) ..... 102019000011463

(51) Int. Cl.

| | |
|---|---|
| ***B41F 23/04*** | (2006.01) |
| ***B41F 16/02*** | (2006.01) |
| ***B41J 11/00*** | (2006.01) |
| ***B65H 27/00*** | (2006.01) |

(52) U.S. Cl.

CPC ..... *B41F 23/042* (2013.01); *B41F 16/02* (2013.01); *B41F 23/0413* (2013.01); *B41F 23/0426* (2013.01); *B41F 23/0436* (2013.01); *B41J 11/002* (2013.01); *B65H 27/00* (2013.01); *B65H 2301/517* (2013.01); *B65H 2301/5143* (2013.01); *B65H 2557/512* (2013.01); *B65H 2701/174* (2013.01)

(58) Field of Classification Search

CPC ..... B41F 23/042

USPC ..... 101/424.1

See application file for complete search history.

(56) References Cited

U.S. PATENT DOCUMENTS

| | | | | |
|---|---|---|---|---|
| 2,047,372 | A * | 7/1936 | Jalens | B41F 23/0489 101/416.1 |
| 2,739,218 | A | 3/1956 | Eric | |
| 4,618,240 | A * | 10/1986 | Sakurai | G03G 15/2053 219/216 |
| 4,825,242 | A * | 4/1989 | Elter | G03G 15/2003 219/216 |
| 2014/0326415 | A1* | 11/2014 | Tamborini | B32B 37/06 156/583.1 |
| 2018/0281498 | A1* | 10/2018 | Yamamoto | B41M 7/009 |

FOREIGN PATENT DOCUMENTS

| | | |
|---|---|---|
| EP | 0568172 A1 | 11/1993 |
| EP | 3473438 A1 | 4/2019 |

OTHER PUBLICATIONS

International Search Report dated Mar. 30, 2020. 8 pages.

* cited by examiner

*Primary Examiner* — Anthony H Nguyen
(74) *Attorney, Agent, or Firm* — RMCK Law Group PLC

(57) ABSTRACT

A thermosetting unit, in particular for a textile printer, includes a pair of stationary supports, a thermosetting roller extending between said stationary supports and rotatably carried by said stationary supports around a longitudinal axis thereof, a stationary infrared lamp extending inside said thermosetting roller and having opposite ends supported by said stationary supports, and a temperature-uniforming device housed inside the thermosetting roller.

12 Claims, 8 Drawing Sheets

THERMOSETTING UNIT, IN PARTICULAR FOR A TEXTILE PRINTER

CROSS-REFERENCE TO RELATED APPLICATION

This application claims priority to Italian Patent Application No. 102019000011463, filed on Jul. 11, 2019. The disclosure of the above application is incorporated herein by reference in its entirety.

FIELD OF THE INVENTION

The present invention relates to a thermosetting unit.

The invention was developed, in particular, with a view to its application to the field of digital printing on fabrics. In the following description, reference will be made to this specific field without however losing generality.

DESCRIPTION OF THE PRIOR ART

In processes of digital printing on fabrics, thermosetting of the inks on the fabrics may be necessary. In these cases, it is common to use a thermosetting unit comprising a plurality of rollers through which the fabric is passed downstream of the printing unit. The thermosetting unit can be an integral part of the textile printer (in-line thermosetting) or it can be separate with respect to the textile printer.

The thermosetting unit is generally provided with at least one thermosetting roller, having an outer surface heated to temperatures that can reach up to 200° C.

Heating of the thermosetting roller can be obtained by means of a heating circuit using a diathermic fluid circulating inside the heated roller.

Thermosetting rollers are also known that comprise heating elements formed by infrared lamps.

The document EP-A-3473438 by the same Applicant describes a thermosetting unit, in particular for a textile printer, comprising:

- a pair of stationary supports,
- a thermosetting roller rotatably carried by the stationary supports around a longitudinal axis,
- a stationary infrared lamp extending inside said thermosetting roller and having opposite ends supported by said stationary supports.

The heating of the thermosetting rollers by means of infrared lamps offers considerable advantages with respect to heating systems using diathermic fluids, especially in that they do not require a circuit for heating and circulation of the diathermic fluid inside the roller.

The infrared lamp generally comprises a quartz crystal body having an electrical resistance therein that emits light in the infrared spectrum (at medium-, short-, and long-waves). The lamp reaches temperatures on the surface of the quartz crystal body close to or higher than 500-600° C.

One limit of the thermosetting rollers heated by infrared lamps resides in the fact that the heat produced by the infrared lamp is not distributed evenly along the longitudinal direction of the roller. This problem is further accentuated when the thermosetting roller is longer than 1 meter.

It has been observed that, on the outer surface of a thermosetting roller heated by means of an infrared lamp, there may be differences in temperature that may even reach more than 10° C. in the direction of the longitudinal axis of the roller.

This variation in temperature on the outer surface of a thermosetting roller may cause uneven fixing of the colors, which could compromise the quality of the thermosetting treatment, particularly in the case of very large fabrics.

OBJECT AND SUMMARY OF THE INVENTION

The object of the present invention is to provide a thermosetting unit that overcomes the problems of the prior art.

According to the present invention, this object is achieved by a thermosetting unit having the characteristics forming the subject of the claims.

The claims form an integral part of the disclosure provided here in relation to the invention.

BRIEF DESCRIPTION OF THE DRAWINGS

The present invention will now be described in detail with reference to the attached drawings, given purely by way of non-limiting example, wherein.

DETAILED DESCRIPTION

Figure 1:
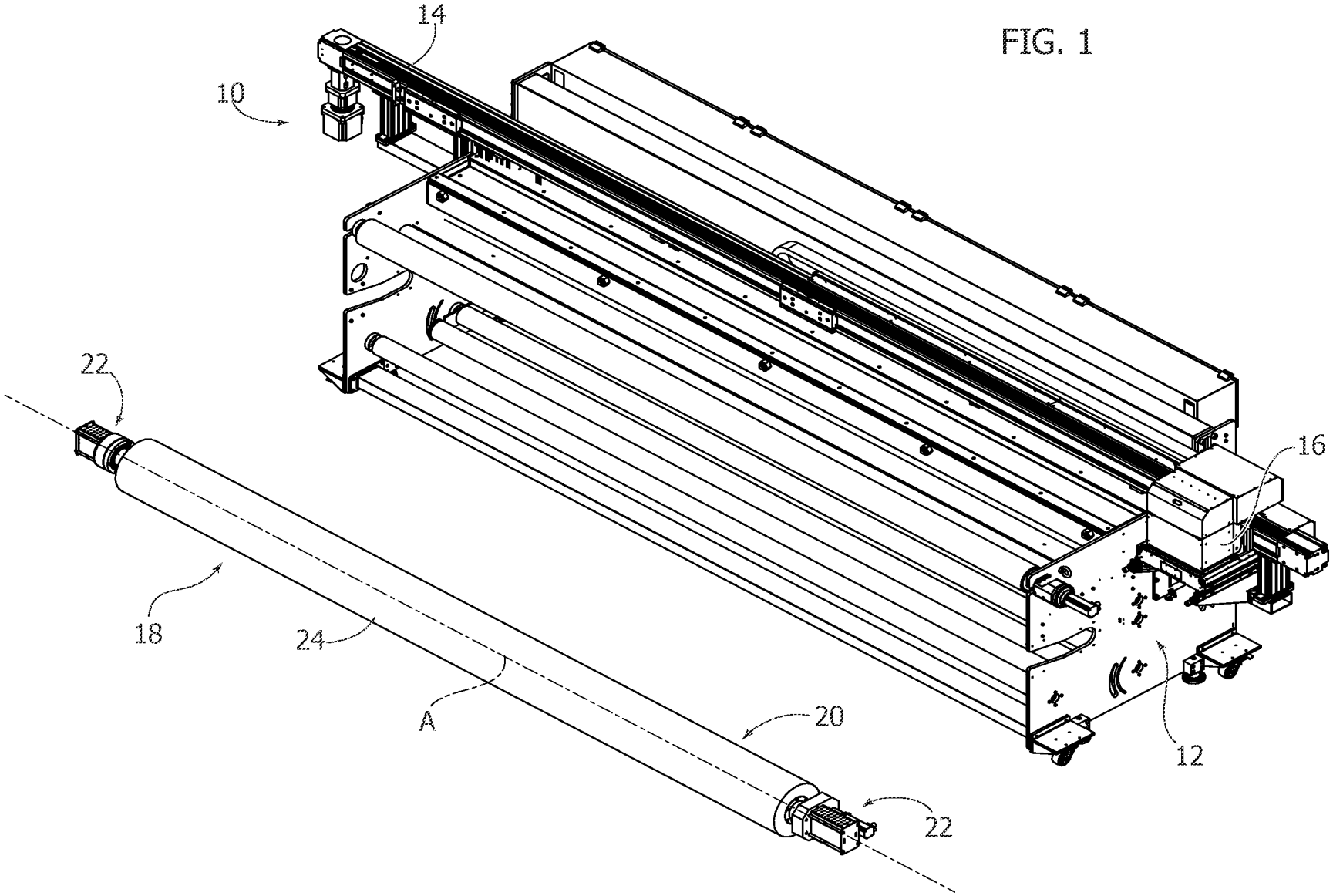
FIG. 1 is a partially exploded perspective view of a textile printer comprising a thermosetting unit.

In FIG. 1, numeral 10 indicates a textile printer for digital printing on fabrics. The textile printer 10 comprises a frame 12 carrying a horizontal bar 14 along which an inkjet printing head 16 is movable.

The textile printer 10 can comprise a thermosetting unit 18 for thermosetting the inks onto the fabric after printing. The thermosetting unit 18 comprises a thermosetting roller 20, illustrated in an exploded position in the representation of FIG. 1.

In the example shown in FIG. 1, the thermosetting unit 18 is integrated into the textile printer 10. In a possible embodiment, the thermosetting unit 18 can be part of a separate thermosetting apparatus, independent of the textile printer 10.

The thermosetting unit 18 comprises two stationary supports 22, which rotatably support the thermosetting roller 20 around its longitudinal axis A. One of the two stationary supports 22 may carry a motor that rotates the thermosetting roller 20 around the axis A. The stationary supports 22 may be constructed as illustrated in document EP-A-3473438 by the same Applicant.

The thermosetting roller 20 has a cylindrical side wall 24 of metal material, for example, of aluminum or its alloys, having a smooth outer surface on which—during operation—a moving fabric is wound downstream of the printing section.

The thermosetting roller 20 is hollow and a heating device is housed therein, which heats the cylindrical wall 24 at temperatures in the order of 200° C.

During operation, the fabric at the outlet of the printing section moves in contact with the outer surface of the heated thermosetting roller 20. The heat that is transferred from the thermosetting roller 20 to the moving fabric carries out the thermosetting of the inks on the printed surface of the fabric.

Figures 2, 3:
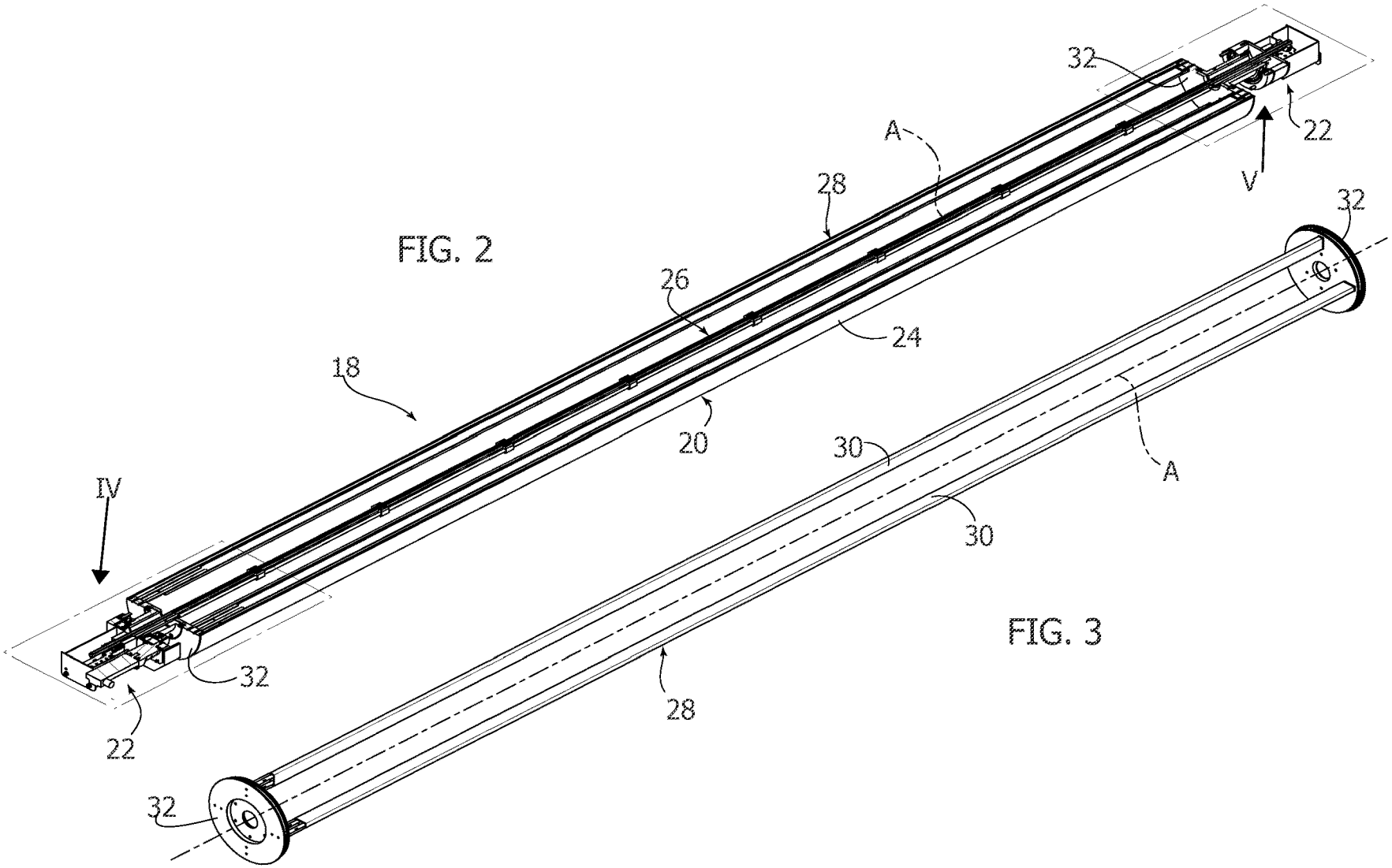
FIG. 2 is a cross-sectioned perspective view of a first embodiment of a thermosetting roller.
FIG. 3 is a perspective view of a temperature-uniforming device of the thermosetting roller of FIG. 2, FIGS. 4 and 5 are prospective views on an enlarged scale of the parts indicated by the arrows IV and V in FIG. 2.
Figures 6, 7:
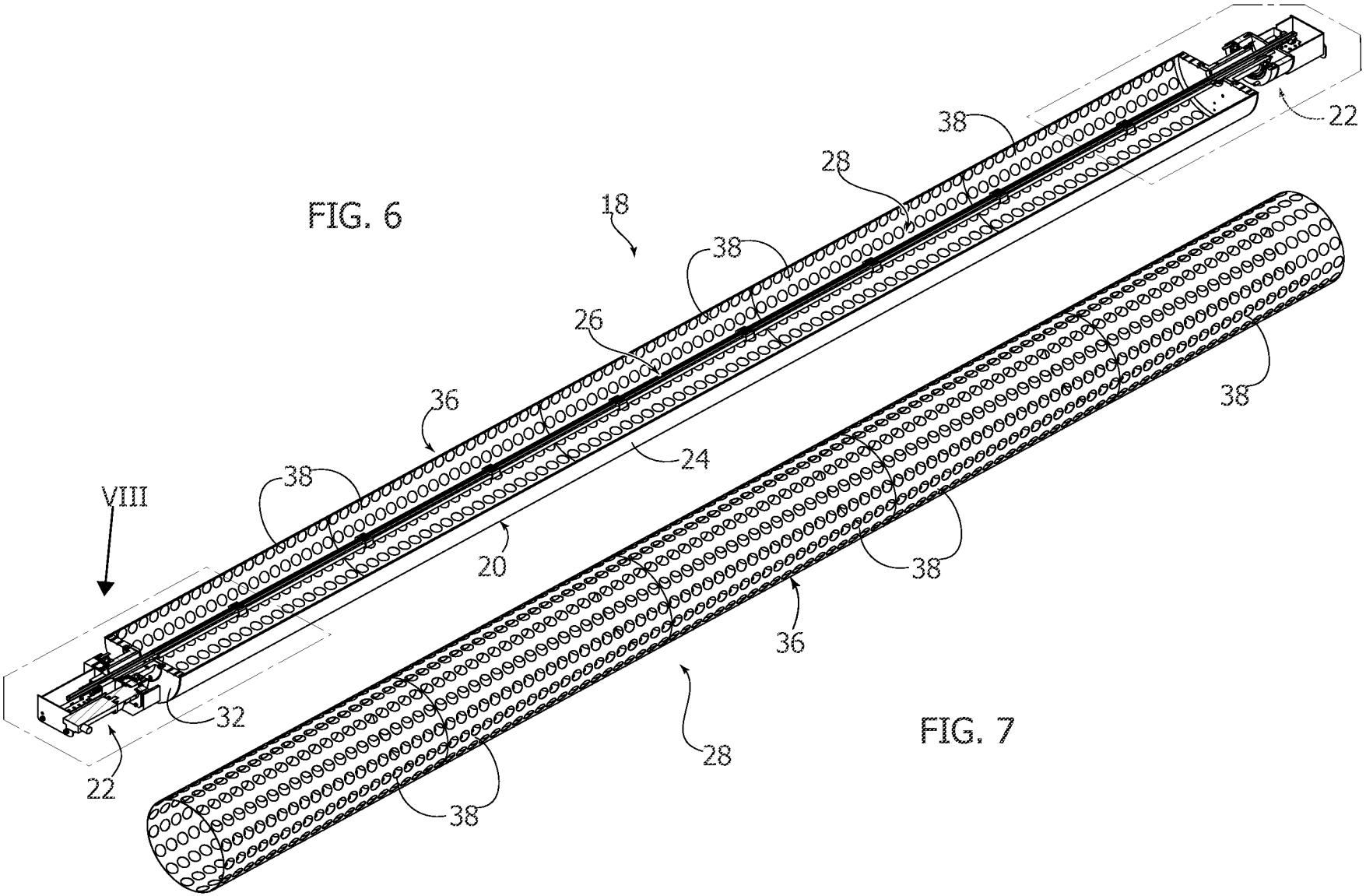
FIG. 6 is a cross-sectioned perspective view of a second embodiment of a thermosetting roller.
FIG. 7 is a perspective view of a temperature-uniforming device of the thermosetting roller of FIG. 6.
Figure 9:
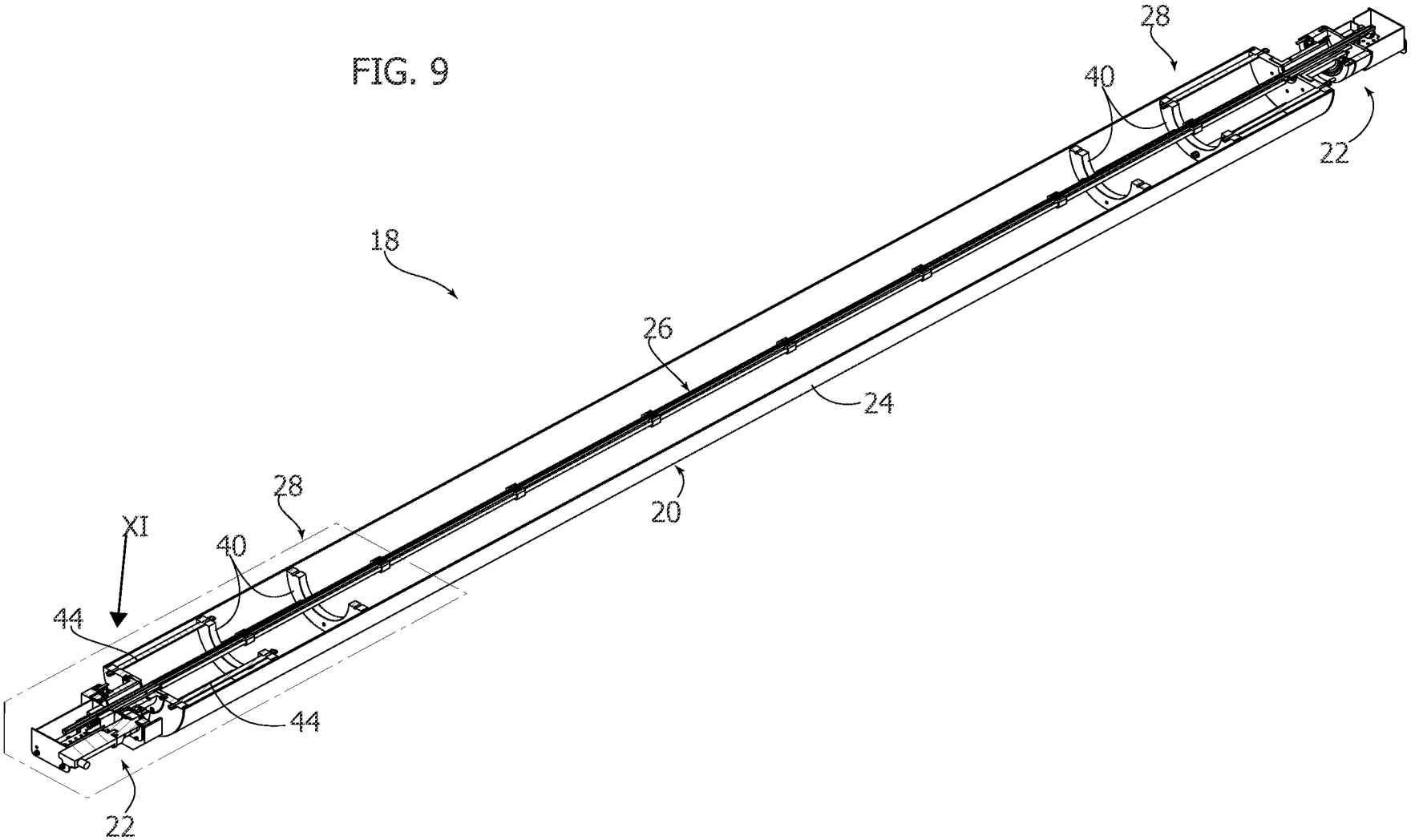
FIG. 9 is a cross-sectioned perspective view of a third embodiment of a thermosetting roller.

With reference to FIGS. 2, 6 and 9, the thermosetting unit 18 comprises an infrared lamp 26, which extends inside the thermosetting roller 20. The infrared lamp 26 is fixed with respect to the stationary supports 22, and extends along the longitudinal axis A for a length greater than the length of the thermosetting roller 20. The side ends of the infrared lamp 26 project laterally outwards of the thermosetting roller 20, and rest on respective bases belonging to the stationary supports 22. The infrared lamp 26 can be supported inside the thermosetting roller 20 by a support device that can be made as described in document EP-A-3473438. During operation, the infrared lamp 26 is stationary and the thermosetting roller 20 rotates around the longitudinal axis A around the infrared lamp 26. The side wall 24 of the thermosetting roller 20 heats up mainly due to the radiation produced by the infrared radiation emitted by the infrared lamp 26.

The thermosetting unit 18 comprises a temperature-uniforming device 28 housed inside the thermosetting roller 20. The temperature-uniforming device 28 has the object of making the temperature of the side wall 24 of the thermosetting roller 20 more uniform along the longitudinal axis A.

Figure 4:
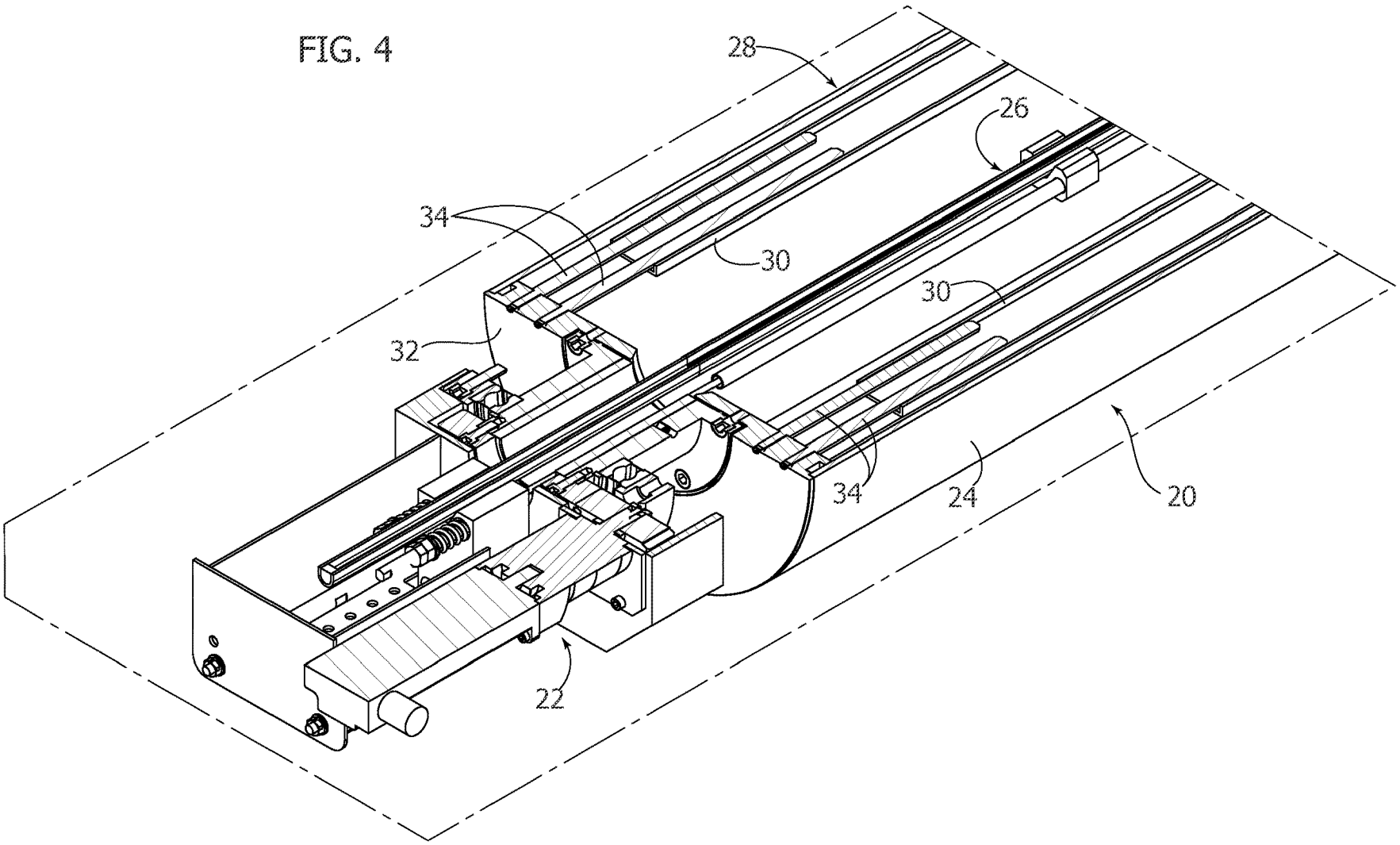
Figure 5:
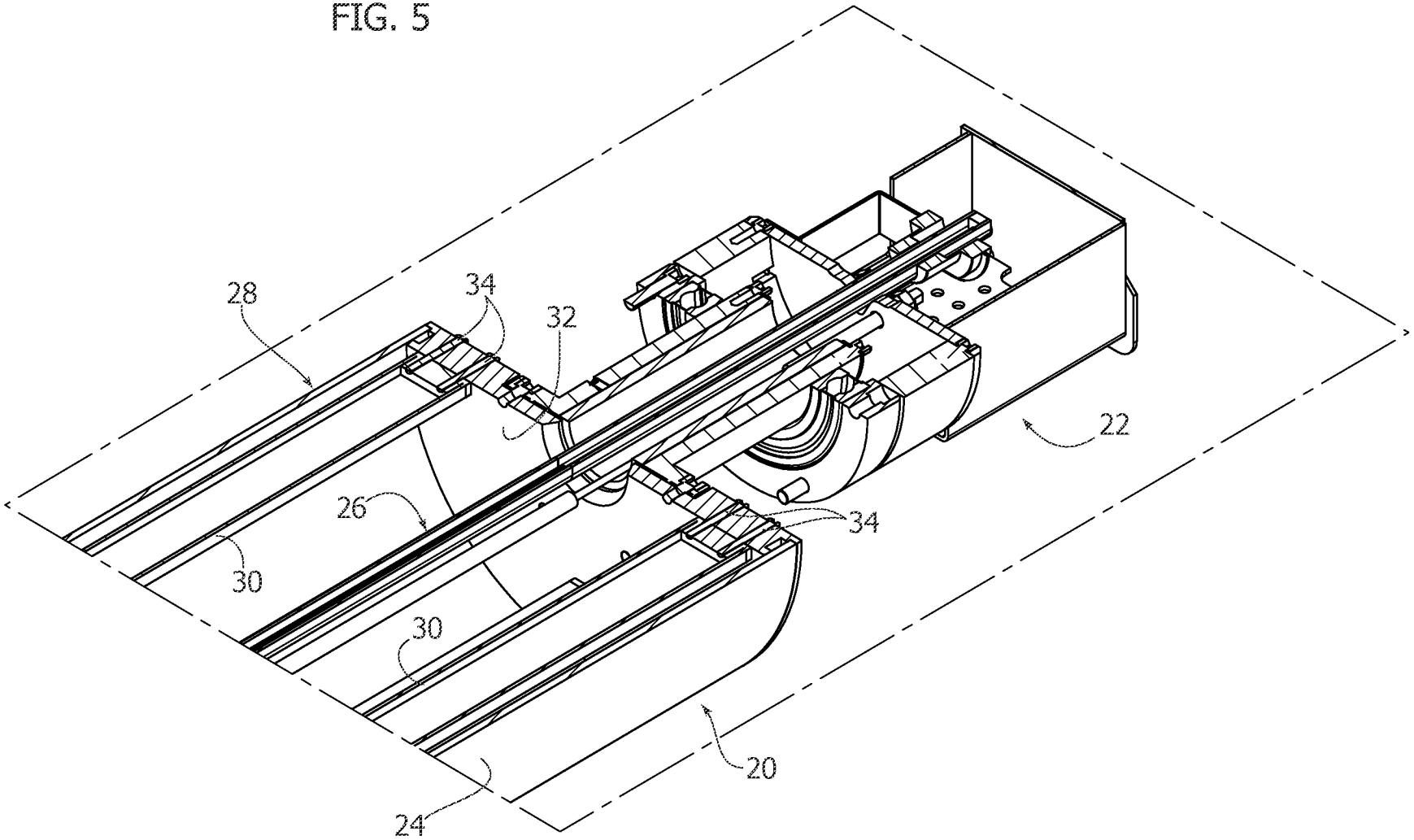

With reference to FIGS. 3-5, in a possible embodiment, the temperature-uniforming device 28 comprises at least one longitudinal bar 30 fixed to the thermosetting roller 20 and protruding radially inwards from the inner surface of the thermosetting roller 20. In the embodiment illustrated by way of example in the figures, the temperature-uniforming device 28 comprises two longitudinal bars 30 opposite each other and fixed at their ends to the front walls 32 of the thermosetting roller 20. The longitudinal bars 30 can be made of aluminum and can be hollow to reduce the weight. In the illustrated example, the longitudinal bars 30 extend over the entire length of the thermosetting roller 20.

With reference to FIGS. 4 and 5, the longitudinal bars 30 can be fixed to the front walls 32 of the thermosetting roller 20 by means of longitudinal pins 34. The longitudinal bars 30 are fixed with respect to the thermosetting roller 20 and, during operation, rotate together with the thermosetting roller 20 around the longitudinal axis A. Rotation of the bars 30 produces a whirling movement of the air between the infrared lamp 26 and the inner surface of the thermosetting roller 20, thus promoting the distribution of heat uniformly along the side wall 24 of the thermosetting roller 20 in the direction of the longitudinal axis A. During operation, the thermosetting roller 20 is constantly kept rotating around the axis A, so that a continuous movement of air is generated inside the thermosetting roller 20, which has an efficient action of uniforming the temperature of the side wall 24 of the thermosetting roller 20 along the longitudinal axis A.

The longitudinal pins 34 that fix the longitudinal bars 30 to the front walls 32 of the thermosetting roller allow the support of the bars 30 and allow the differentiated deformation between the longitudinal bars and the outer wall 24 of the thermosetting roller 20 caused by the thermal expansion.

Figure 8:
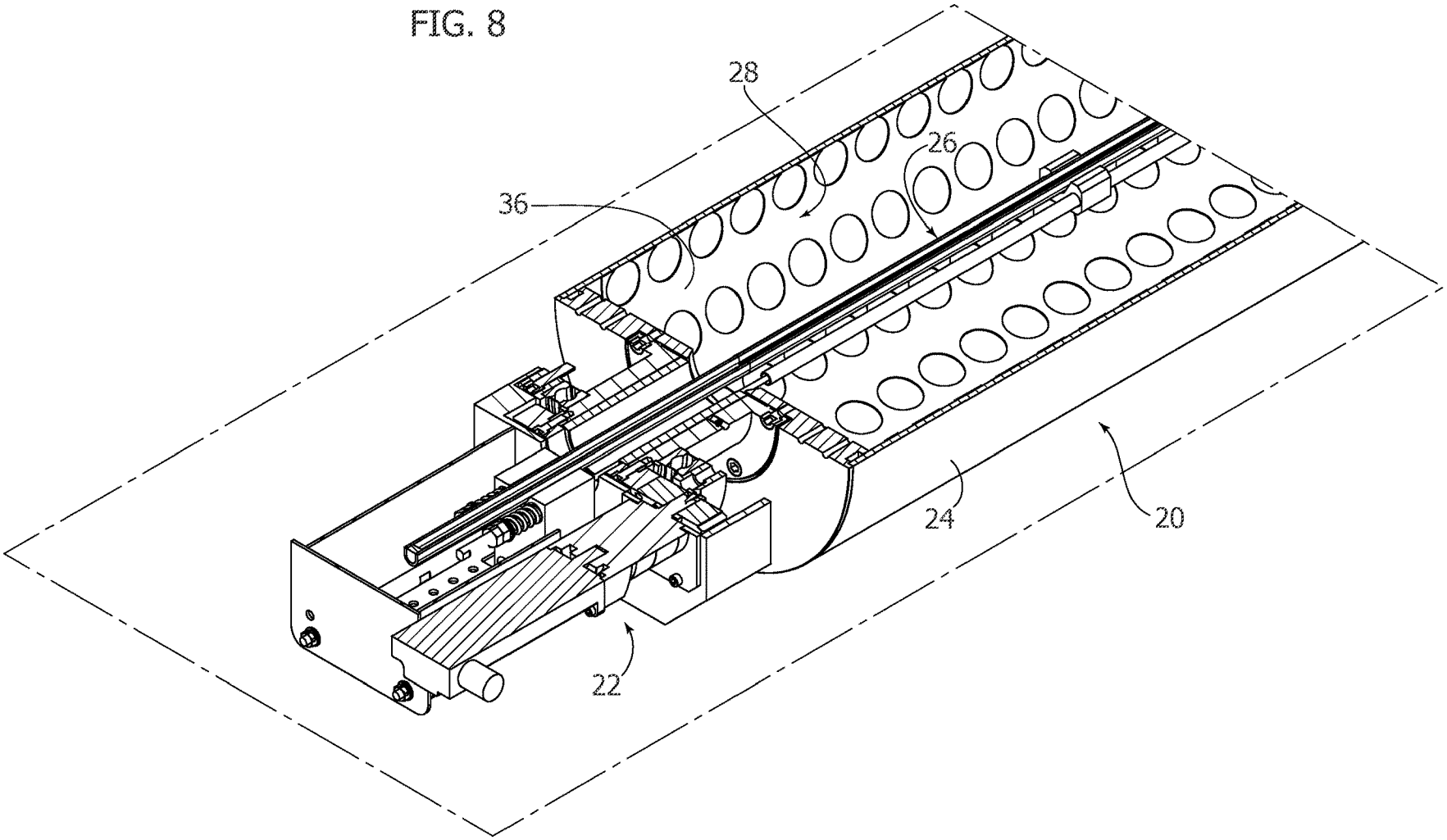
FIG. 8 is a perspective view on a larger scale of the part indicated by the arrow VIII in FIG. 6.

With reference to FIGS. 6, 7 and 8, in a possible embodiment, the temperature-uniforming device 28 comprises a tubular sleeve 36 which extends coaxially to the side wall 24 of the thermosetting roller 20 in contact with at least a part of the inner surface of the thermosetting roller 20. The tubular sleeve 36 may be formed by a perforated metal sheet folded to form a cylindrical shape. The metal sheet forming the tubular sleeve 36 may have a thermal conductivity lower than the thermal conductivity of the side wall 24 of the thermosetting roller 20. For example, the tubular sleeve 36 could be formed of a perforated sheet or of a steel mesh, while the side wall 24 of the thermosetting roller 20 can be made of aluminum. The tubular sleeve 36 may extend along the entire length of the thermosetting roller 20, as in the embodiment illustrated in FIGS. 6 and 7, or only at selected areas of the side wall 24 of the thermosetting roller 20, for example, only at the side ends of the roller 20. The tubular sleeve 36 can be formed of a plurality of sections 38 aligned with each other along the longitudinal axis A.

The tubular sleeve intercepts and captures the heat radiated by the infrared lamp 26 and transfers the heat by conduction along the longitudinal axis A. The tubular sleeve 36 is in direct contact with the inner surface of the thermosetting roller 20 so that the heat collected by the tubular sleeve 36 is transferred by conduction to the side wall 24 of the thermosetting roller 20. In this way, the tubular sleeve 36 allows uniforming of the temperature of the side wall 24 of the thermosetting roller 20 along the longitudinal axis A. The effect of interception and storage of the heat in the tubular sleeve 36 can be increased by virtue of the fact that the tubular sleeve 36 may have a thermal conductivity lower than that of the material constituting the thermosetting roller 20. In the illustrated example, the tubular sleeve 36 can be formed of a sheet, for example, of stainless steel, in which a plurality of parallel arrays of circular holes are formed. The diameter of the holes and, consequently, the dimensions of the material comprised between the holes, are determined so as to provide a correct thermal balance between the radiated heat that is intercepted by the tubular sleeve 36 and transferred by conduction to the side wall 24 of the thermosetting roller 20, and the heat that is radiated directly onto the side wall 24 of the thermosetting roller 20.

Figure 10:
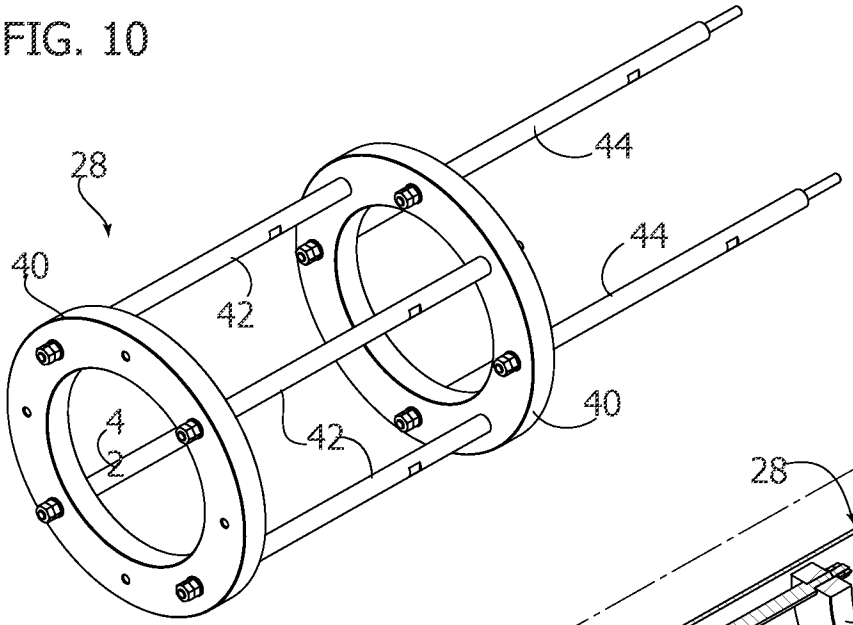
FIG. 10 is a partial perspective view of the temperature-uniforming device of the thermosetting roller of FIG. 9.
Figure 11:
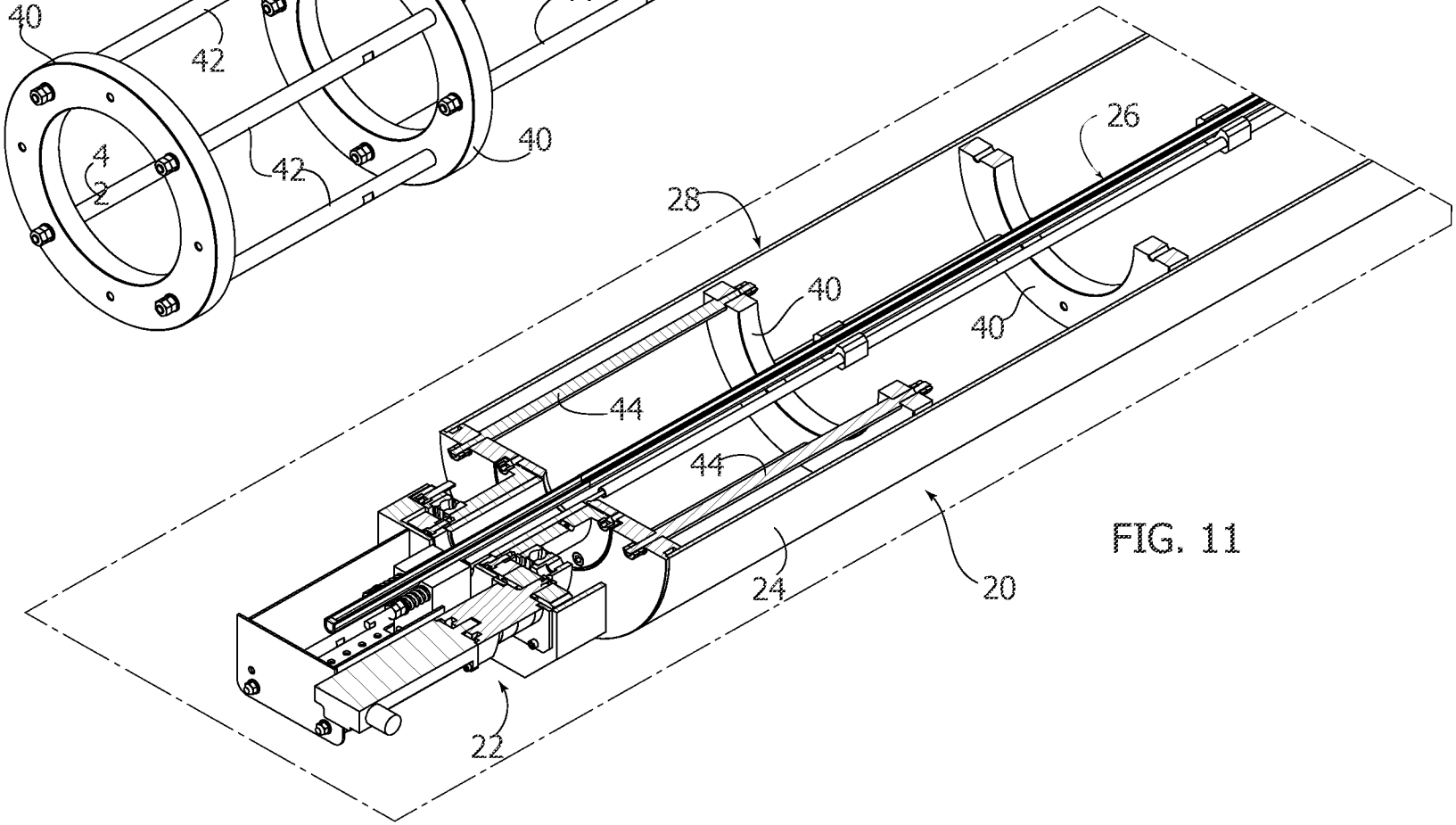
FIG. 11 is a perspective view on a larger scale of the part indicated by the arrow XI in FIG. 9.

With reference to FIGS. 9-11, in a possible embodiment, the temperature-uniforming device 28 may comprise a plurality of metal rings 40 fixed with respect to the thermosetting roller 20, and orthogonal to the longitudinal axis A. The metal rings 40 surround the infrared lamp 26 without contact, and have respective outer surfaces in contact with the inner surface of the side wall 24 of the thermosetting roller 20. The rings 40 can be hollow and can be fixed together by means of longitudinal pins 42. The ring 40 closest to a side end of the thermosetting roller 20 can be fixed to the front wall 32 of the thermosetting roller 20 by means of longitudinal pins 44. The rings 40 can be arranged only at the side ends of the thermosetting roller 20, which are the areas in which the heat produced by the infrared lamp 26 may be insufficient to guarantee an optimal thermosetting of the colors. In fact, the heat produced by the infrared lamp 26 is concentrated more in the central area of the thermosetting roller 20 where correct working temperatures in the order of 180-200° C. are reached.

In the side areas of the thermosetting roller 20, the metal rings 40 heat by irradiation and transfer heat by conduction to the side wall 24 of the thermosetting roller 20. The greater mass at the side ends of the thermosetting roller 20 formed by the metal rings 40 allows storage of a greater quantity of the heat radiated by the infrared lamp, and transfer of the heat by conduction to the side portions of the thermosetting roller 20. The metal rings 40, therefore, constitute thermal bridges capable of capturing the heat in the inner areas adjacent to the infrared lamp 26 and of transferring the heat to the side wall 24 of the thermosetting roller 20, making the temperature distribution of the side wall 24 of the thermosetting roller 20 more uniform along the longitudinal axis A. The rings 40 can be hollow to reduce the weight and can be made of aluminum to optimize heat transmission.

The different embodiments of the temperature-uniforming device 28 could also be combined with each other in various ways in the same thermosetting roller 20. Therefore, a thermosetting roller 20 could comprise two or more of the different embodiments of the temperature-uniforming devices 28 combined together in various ways.

Of course, without prejudice to the principle of the invention, the details of construction and the embodiments can be widely varied with respect to those described and illustrated, without thereby departing from the scope of the invention as defined by the claims that follow.

The invention claimed is:

1. A thermosetting unit, comprising:

a pair of stationary supports, a thermosetting roller having a longitudinal axis, extending between said pair of stationary supports and rotatably carried by said pair of stationary supports around said longitudinal axis, a stationary infrared lamp extending inside said thermosetting roller and having opposite ends supported by said pair of stationary supports, and a temperature-uniforming device housed inside the thermosetting roller, the temperature-uniforming device including at least one longitudinal bar fixed to the thermosetting roller and projecting radially inwardly from an inner surface of the thermosetting roller, wherein said at least one longitudinal bar produces a swirling movement of air between the infrared lamp and the inner surface of the thermosetting roller during rotation of the thermosetting roller around said longitudinal axis.

2. The thermosetting unit according to claim 1, wherein said at least one longitudinal bar extends over an entire length of the thermosetting roller.

3. The thermosetting unit according to claim 2, wherein said at least one longitudinal bar is fixed to opposite front walls of the thermosetting roller.

4. The thermosetting unit according to claim 2, wherein the at least one longitudinal bar of the temperature-uniforming device comprises at least two longitudinal bars opposite to each other.

5. A thermosetting unit, comprising:

a pair of stationary supports, a thermosetting roller having a longitudinal axis, extending between said pair of stationary supports and rotatably carried by said pair of stationary supports around said longitudinal axis, a stationary infrared lamp extending inside said thermosetting roller and having opposite ends supported by said pair of stationary supports, and a temperature-uniforming device housed inside the thermosetting roller, the temperature-uniforming device including at least one perforated tubular sleeve coaxial to a side wall of the thermosetting roller and having an outer surface in contact with at least a part of an inner surface of the thermosetting roller.

6. The thermosetting unit according to claim 5, wherein said perforated tubular sleeve is formed by a perforated metal sheet folded into a tubular shape.

7. The thermosetting unit according to claim 5, wherein said perforated tubular sleeve is formed of a material having a thermal conductivity less than a thermal conductivity of a material forming the thermosetting roller.

8. The thermosetting unit according to claim 5, wherein said perforated tubular sleeve comprises a plurality of sections aligned with each other along said longitudinal axis.

9. A thermosetting unit, comprising:

a pair of stationary supports, a thermosetting roller having a longitudinal axis, extending between said pair of stationary supports and rotatably carried by said pair of stationary supports around said longitudinal axis, a stationary infrared lamp extending inside said thermosetting roller and having opposite ends supported by said pair of stationary supports, and a temperature-uniforming device housed inside the thermosetting roller, the temperature-uniforming device including a plurality of metal rings fixed with respect to the thermosetting roller and orthogonal to said longitudinal axis, wherein said plurality of metal rings surround the infrared lamp without contact and have outer surfaces in contact with an inner surface of the thermosetting roller.

10. The thermosetting unit according to claim 9, wherein said plurality of metal rings are spaced apart from each other along the longitudinal axis and are fixed to each other by longitudinal pins.

11. The thermosetting unit according to claim 9, wherein at least one of said plurality of metal rings is fixed to a corresponding front wall of the thermosetting roller by longitudinal pins.

12. The thermosetting unit according to claim 9, wherein said plurality of metal rings are hollow.

* * * * *